US008475341B1

(12) United States Patent
Al-Hawaj et al.

(10) Patent No.: US 8,475,341 B1
(45) Date of Patent: Jul. 2, 2013

(54) ARM AND LEG EXERCISING MACHINE

(76) Inventors: Haythem Osamah Al-Hawaj, Mubarak Al-Kabeer (KW); Osamah Mohammad Al-Hawaj, Mubarak Al-Kabeer (KW)

( * ) Notice: Subject to any disclaimer, the term of this patent is extended or adjusted under 35 U.S.C. 154(b) by 0 days.

(21) Appl. No.: 13/587,230

(22) Filed: Aug. 16, 2012

Related U.S. Application Data

(63) Continuation of application No. 13/372,337, filed on Feb. 13, 2012.

(51) Int. Cl.

| | |
|---|---|
| ***A63B 69/16*** | (2006.01) |
| ***A63B 22/12*** | (2006.01) |
| ***A63B 22/00*** | (2006.01) |
| ***A63B 71/00*** | (2006.01) |
| ***A63B 22/06*** | (2006.01) |

(52) U.S. Cl.
USPC ..... 482/62; 482/51; 482/57

(58) Field of Classification Search
USPC ..... 482/51–53, 57–65, 70–71
See application file for complete search history.

(56) References Cited

U.S. PATENT DOCUMENTS

| | | | | |
|---|---|---|---|---|
| D191,792 | S * | 11/1961 | Maratta | D21/665 |
| 4,923,193 | A * | 5/1990 | Pitzen et al. | 482/63 |
| 5,284,462 | A * | 2/1994 | Olschansky et al. | 482/62 |
| 5,314,392 | A * | 5/1994 | Hawkins et al. | 482/57 |
| 5,595,557 | A * | 1/1997 | Lambert et al. | 482/57 |
| 5,906,563 | A * | 5/1999 | Pittari | 482/62 |
| 6,533,708 | B2 * | 3/2003 | Taggett | 482/62 |
| 7,261,675 | B2 * | 8/2007 | Kuo | 482/52 |

OTHER PUBLICATIONS

Prior art cited in parent U.S. Appl. No. 13/372,337, filed Feb. 13, 2012, the priority of which is claimed herein.

* cited by examiner

*Primary Examiner* — Oren Ginsberg
(74) *Attorney, Agent, or Firm* — Richard C. Litman

(57) ABSTRACT

The arm and leg-exercising machine is an apparatus that targets both the upper body and lower body to provide a full body workout. The upper and lower body workouts can be performed separately or simultaneously. The machine includes a generally U-shaped frame fixed to a base. Pedals and lateral handlebars are provided on the frame for respective leg (lower body) and arm (upper body) exercises. A three-drive mechanism including a plurality of pulleys or sprockets is coupled to the pedals and lateral handlebars and joined by bevel gears. A seat is mounted on the frame for strategically positioning an operator to employ the pedals and lateral handlebars.

14 Claims, 9 Drawing Sheets

ARM AND LEG EXERCISING MACHINE

CROSS-REFERENCE TO RELATED APPLICATIONS

This is a continuation of my prior application Ser. No. 13/372,337, filed Feb. 13, 2012 now pending.

BACKGROUND OF THE INVENTION

1. Field of the Invention

The present invention generally relates to exercise apparatus, and particularly to an arm and leg exercising machine for providing a cardiovascular workout regimen for upper and lower body extremities.

2. Description of the Related Art

Medical and physiological professionals are essentially in complete agreement that many of the health problems prevalent in the modern world are related to lack of exercise. Hypertension, diabetes, high blood cholesterol, etc. are conditions that could be minimized or eliminated by following regular cardiovascular and muscle toning exercise regimens. Some of the benefits of regular cardiovascular exercise are that it allows the body to efficiently oxidize fats and carbohydrates, increases the ability to utilize glucose, lowers blood pressure and increases lung capacity. Among the benefits of muscle toning exercises are agility maintenance for the aging body, weight maintenance or loss, and the reduction of the incidence of the ubiquitous lower back pain. It is obvious that there are many other benefits that arise from regular exercise.

There are generally four types of combination cardiovascular and muscle toning exercise machines in the market place today, namely, the treadmill, the stationary bike, the rowing machine, and the elliptical machine. While all of the above-named machines generally function to offer cardiovascular exercise that targets specific muscle groups, none is seen to offer a regimen that provides options of a full body workout, a lower body workout, or an upper body workout. Thus, an arm and leg-exercising machine solving the aforementioned problems is desired.

SUMMARY OF THE INVENTION

The arm and leg-exercising machine is an apparatus that targets both the upper body and lower body to provide a full body workout. The upper and lower body workouts can be performed separately or simultaneously. The machine includes a generally U-shaped frame fixed to a base. Pedals and lateral handlebars are provided on the frame for respective leg (lower body) and arm (upper body) exercises. A three-drive mechanism including an array of pulleys is coupled to the pedals and lateral handlebars. A seat is mounted on the frame for strategically positioning an operator to employ the pedals and lateral handlebars.

Accordingly, the invention presents a single exercise machine that provides a full body workout. Optionally, the machine can be utilized to separately provide either an upper body workout or a lower body workout. The machine has a space-efficient design that allows for home use, but is rugged enough to be used in a gym. Besides cardiovascular benefits, the machine provides upper and lower muscle groups with weight-bearing exercises without attendant harmful loads to the joints. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
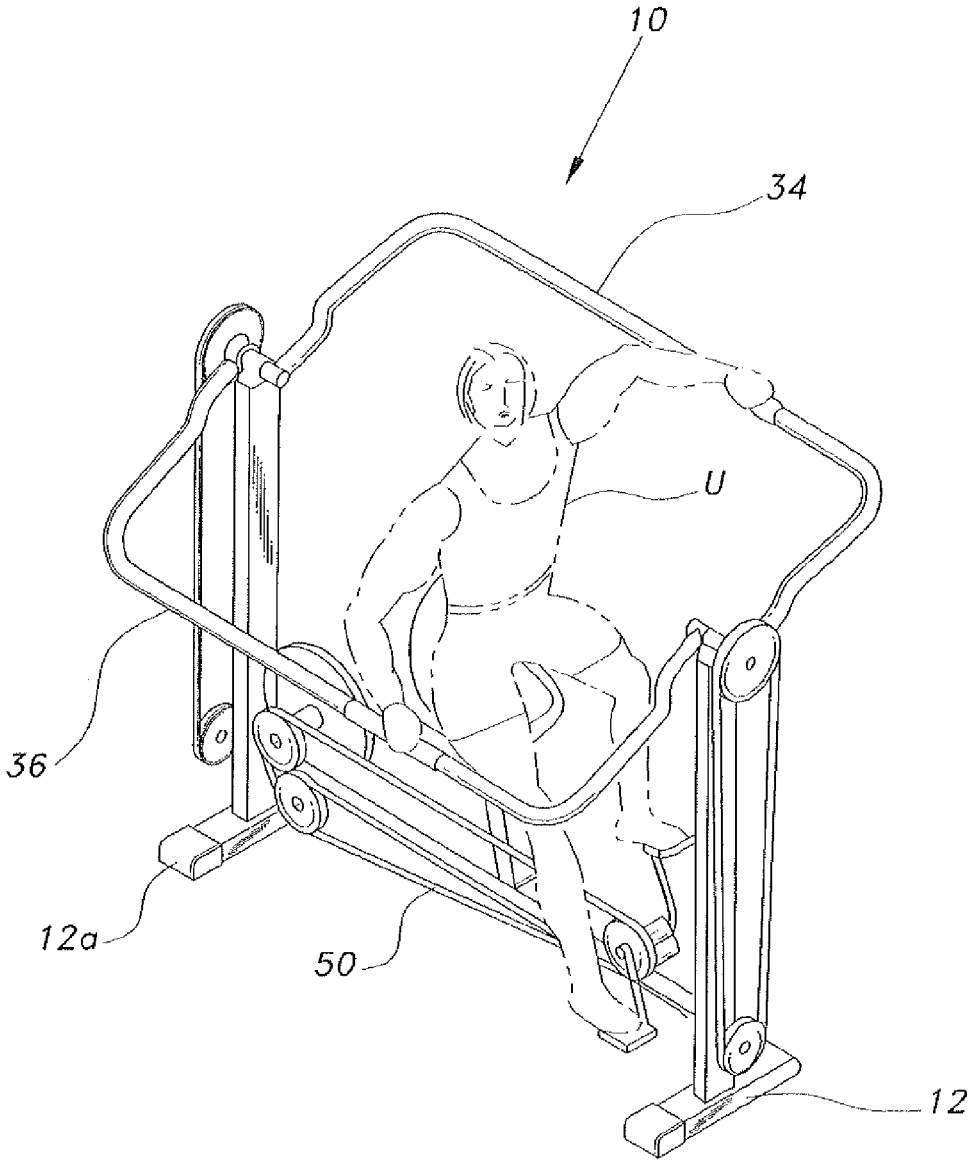
FIG. 1 is an environmental, perspective view of an arm and leg exercising machine according to the present invention.
Figure 2:
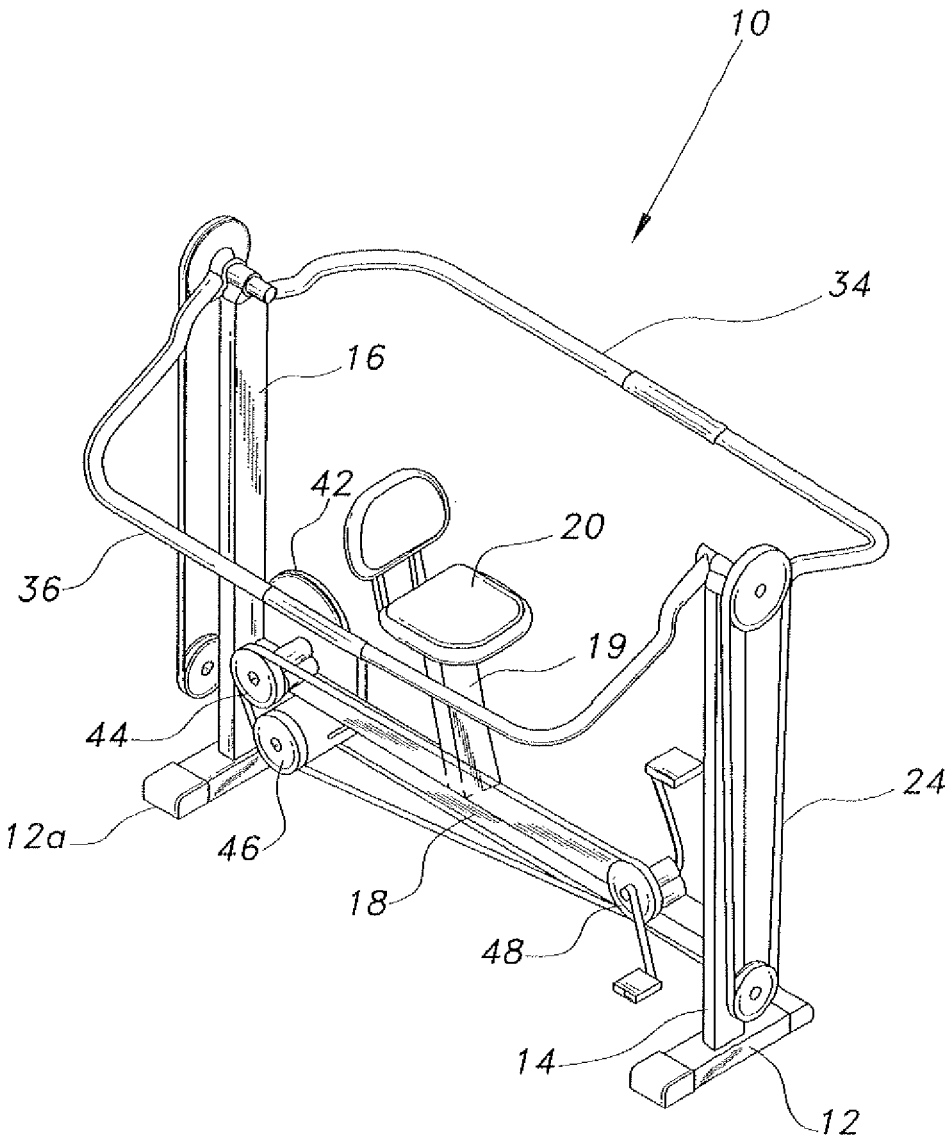
FIG. 2 is a perspective view of the arm and leg exercising machine of FIG. 1.
Figure 3:
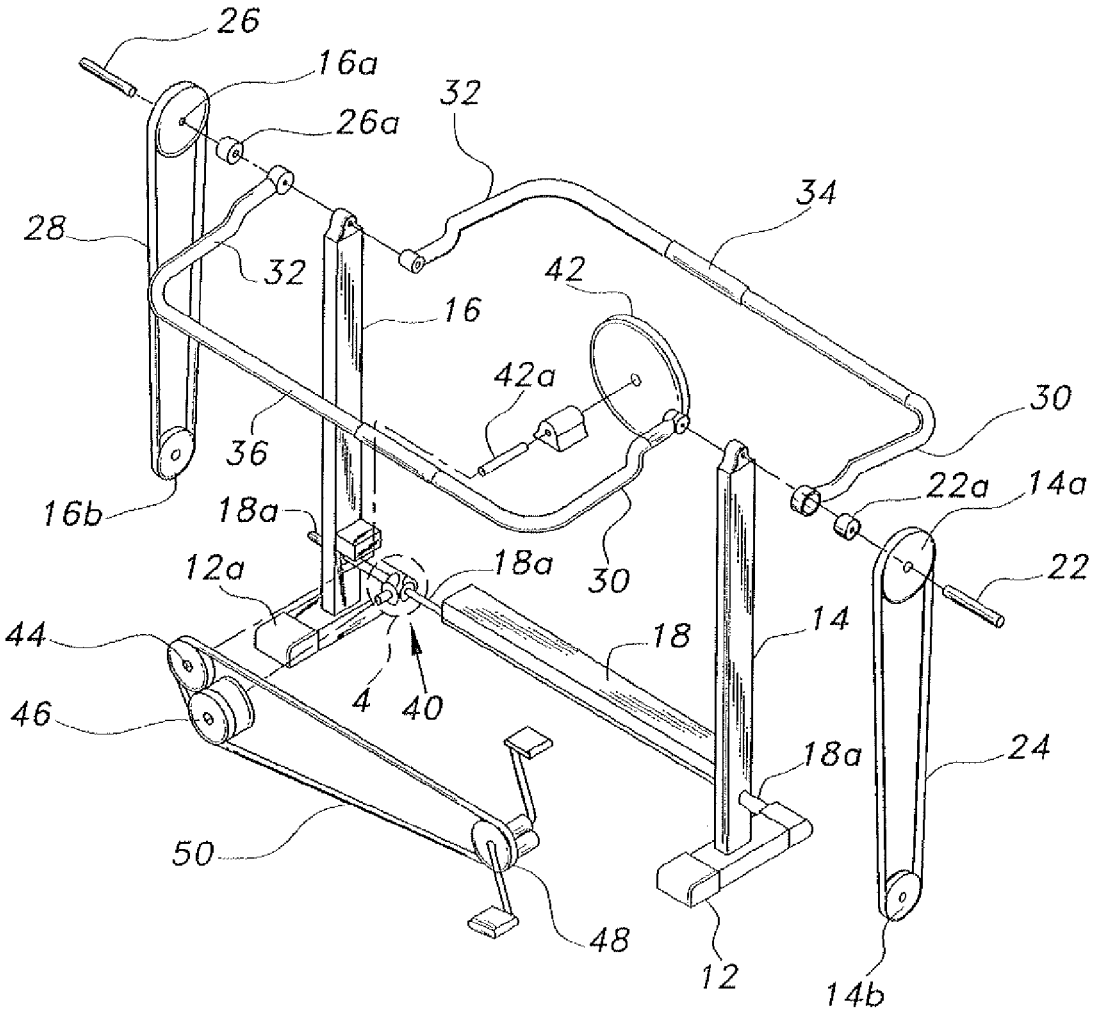
FIG. 3 is an exploded, perspective view of the arm and leg exercising machine of FIG. 1.

Referring to FIGS. 1-4, a first embodiment of the arm and leg exercising machine 10 comprises a generally U-shaped frame mounted on identically configured, spaced-apart base members 12, 12*a*. The frame includes front vertical upright member 14 mounted on base member 12 and rear vertical upright member 16 mounted on base member 12*a*. Horizontally oriented member 18 spans the distance between upright members 14 and 16 and is attached thereto. A split drive shaft 18*a* (or front and rear drive shafts 18*a*) extends through horizontal member 18. A seat support 19 is mounted on the surface of horizontal member 18 and extends upward therefrom. A seat 20 is attached to the upper end of the seat support 19. The seat support 19 is positioned approximately half the distance between vertical members 14 and 16. A front drive mechanism comprises upper and lower pulleys 14*a*, 14*b* mounted adjacent the outer face of front vertical member 14. The front lower pulley 14*b* is mounted on the front end of the drive shaft 18*a*, which is journaled through the front upright member 14 and rotates therein. The front upper pulley 14*b* is mounted on a front upper shaft 22, which is rotationally mounted on the front upright member 14. A clutch 22*a* is mounted on the front upper shaft 22 adjacent the inner face of the upper pulley 14*a*. The clutch 22*a* is fixed to the shaft 22, either by a setscrew or by pressure fit. The clutch 22*a* is a freewheeling clutch so that front upper shaft 22 only rotates in one direction. A front drive belt 24 extends between the upper pulley 14*a* and the lower pulley 14*b*.

A rear drive mechanism comprises upper and lower pulleys 16*a*, 16*b* mounted adjacent the outer face of the rear vertical member 16. The rear lower pulley 16*b* is mounted on the rear end of the drive shaft 18*a*, which is journaled through the rear upright member 16 and rotates therein. The rear upper pulley

16*a* is mounted for rotational movement on a rear upper shaft 26, which is rotationally mounted on the rear upright member 16. A clutch 26*a* is positioned on the rear upper shaft 26 adjacent the inner surface of the pulley 16*a*. The clutch 26*a* is fixed to the shaft 26, either by a setscrew or by pressure fit. The clutch 26*a* is a freewheeling clutch so that rear upper shaft 26 only rotates in one direction. A rear drive belt 28 extends between the rear upper pulley 16*a* and the rear lower pulley 16*b*.

Bilateral front and rear lever arms 30, 32 are mounted on the front upper shaft 22 and the rear upper shaft 26, respectively, for arcuate movement thereon. Handlebars 34, 36, span the distance between the forward and rear lever arms 30, 32 and are attached thereto. The handlebars 34, 36 are laterally arranged on opposite sides of the frame and are positioned for grasping by the operator U. One of the front lever arms 30, e.g., the arm 30 attached to handlebar 34, may be rigidly attached to the front upper shaft 22*a*, or preferably is rigidly attached to the outer housing or outer race of the clutch 22*a*, so that the clutch 22*a* engages in order to rotate the front upper pulley 14*a* when the handlebar 34 is rotated in one direction, but the clutch 22*a* disengages so that the handlebar 34 rotates freely without rotating the front upper pulley 14*a* when the handlebar 34 is rotated in the opposite direction. The rear lever arm 32 attached to handlebar 34 is rotatably attached to the rear upper shaft 26. Thus, rotation of handlebar 34 causes the front pulley system and the front portion of drive shaft 18*a* to rotate. The front lever arm 30 attached to the opposite handlebar 36 may be rotatably attached to the front upper shaft 22*a*, while the rear lever arm 32 extending from handlebar 36 is rigidly attached to the rear upper shaft 26, or preferably is rigidly attached to the outer housing or outer race of the clutch 26*a*, so that the clutch 26*a* engages in order to rotate the rear upper pulley 16*a* and the rear portion of drive shaft 18*a* when the handlebar 36 is rotated in one direction, but the clutch 26*a* disengages so that the handlebar 36 rotates freely without rotating the rear upper pulley 16*a* when the handlebar 36 is rotated in the opposite direction. Thus, the device provides for a forward drive mechanism and a rearward drive mechanism, depending upon which handlebar is depressed.

Figure 4:
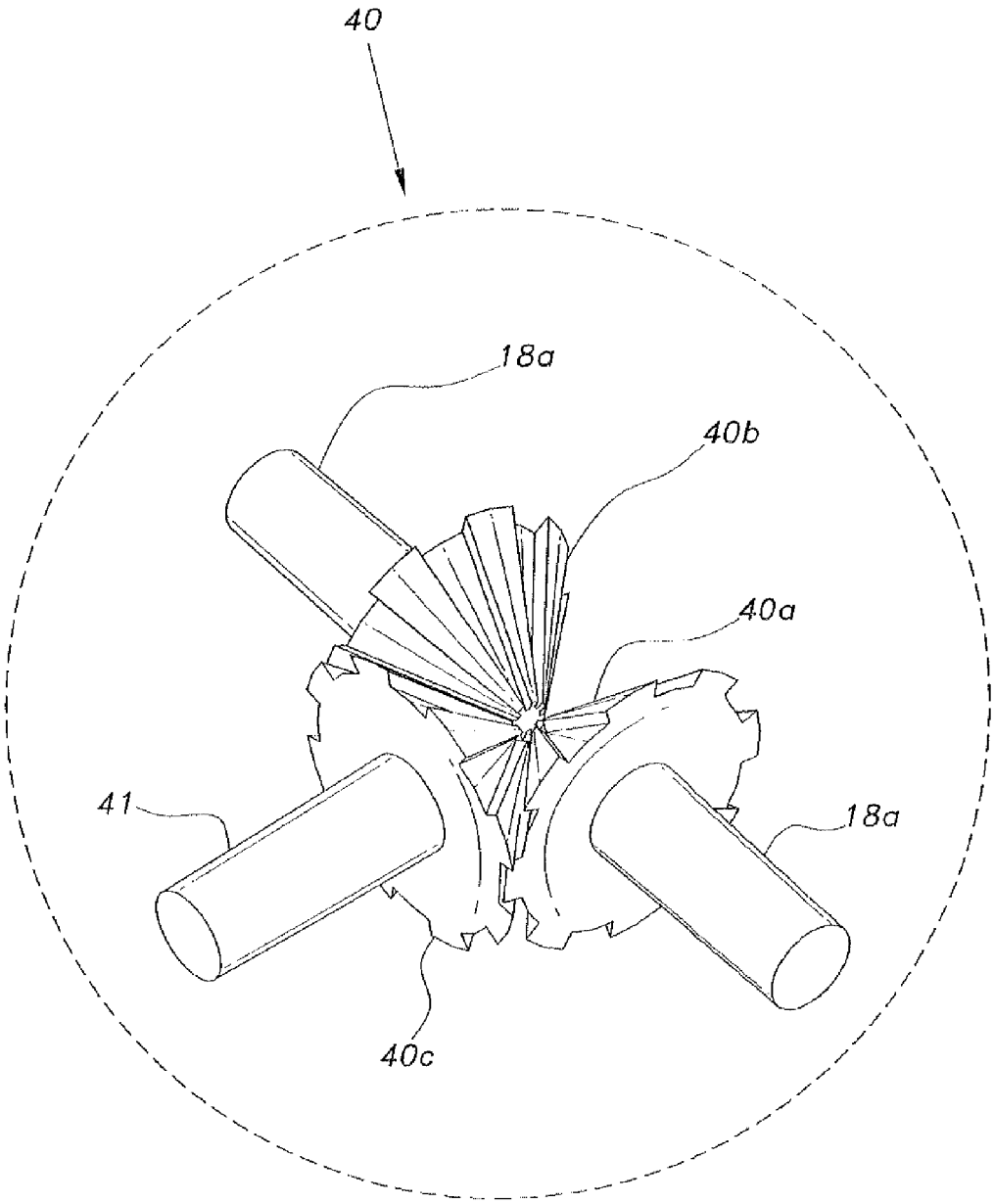
FIG. 4 is a partial view showing details of the gear mechanism of the arm and leg exercising machine of FIG. 3.

A middle drive mechanism comprises a bevel gear arrangement 40, a flywheel 42, double pulleys 44, 46, a pedal-pulley arrangement 48 and a middle drive belt 50. As best seen in FIG. 4, the bevel gear arrangement 40 includes three meshed, identically configured bevel gears 40*a*, 40*b* and 40*c*. The gears 40*a* and 40*b* are mounted on front and rear portions of the drive shaft 18*a*, respectively. The third gear 40*c* is mounted to one end of a shaft 41 that extends perpendicular to the drive shaft 18*a* and extends horizontally therefrom. The other end of the shaft 41 is attached to pulley 46. The flywheel 42 is mounted on one end of a flywheel shaft 42*a*. The other end of the flywheel shaft 42*a* is attached to pulley 44. Pedal-pulley arrangement 48 is positioned forward of the double pulleys 44, 46 and is connected thereto by the middle drive belt 50.

In use, the operator has three options. The operator may use swinging arm movements on the handlebars 34, 36 for an upper body workout, the pedal-pulley arrangement being passively driven by the bevel gears 40. Alternatively, the operator may operate the machine 10 using the pedal-pulley arrangement 48 for a lower body workout, the handlebars 34, 36 being passively driven by the bevel gears. Third, the operator may operate the machine 10 both by swinging arm movements on the handlebars 34, 36 and by using the pedal-pulley arrangement 48, thereby providing a full body workout.

Figure 5:
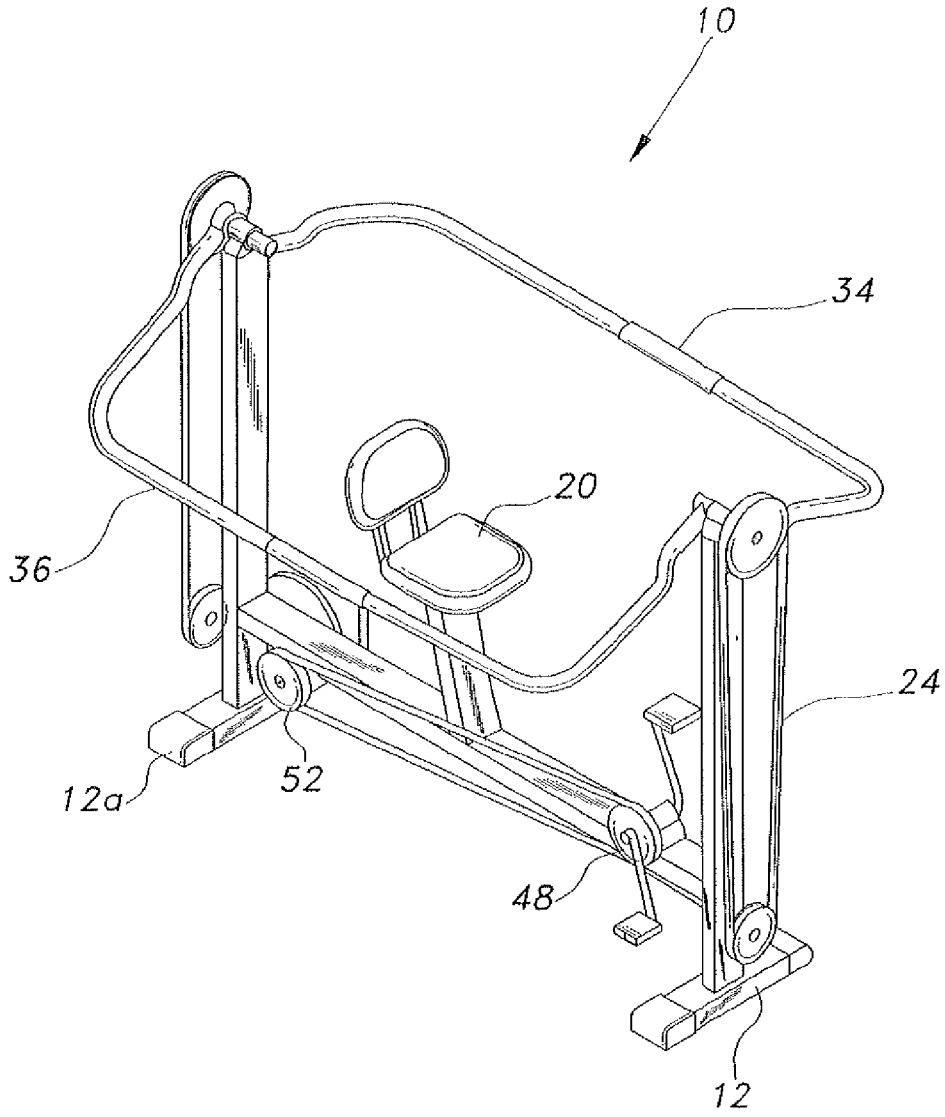
FIG. 5 is a perspective view of a second embodiment of an arm and leg exercising machine according to the present invention.

FIG. 5 shows a second embodiment of the invention wherein only a single pulley 52 is employed in the middle drive mechanism. The advantage of this modification is simplicity of design and lower costs because of the reduction in the number of parts.

Figure 6:
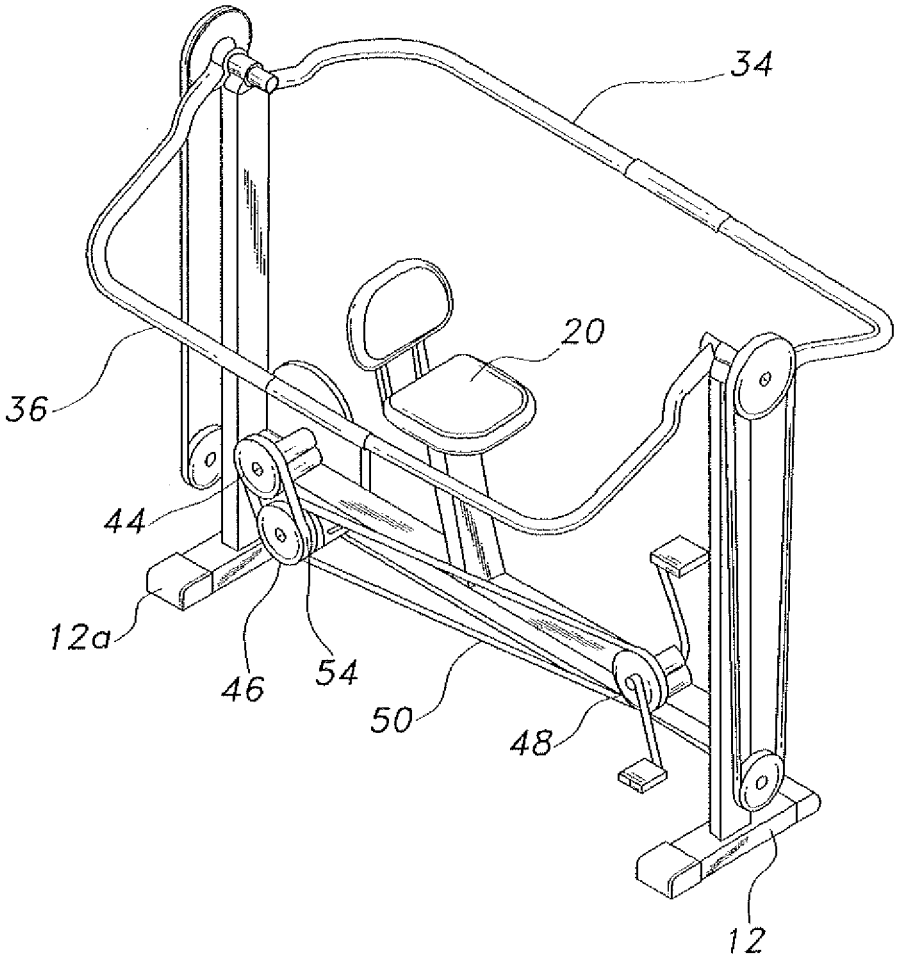
FIG. 6 is a perspective view of a third embodiment of an arm and leg exercising machine according to the present invention.
Figure 7:
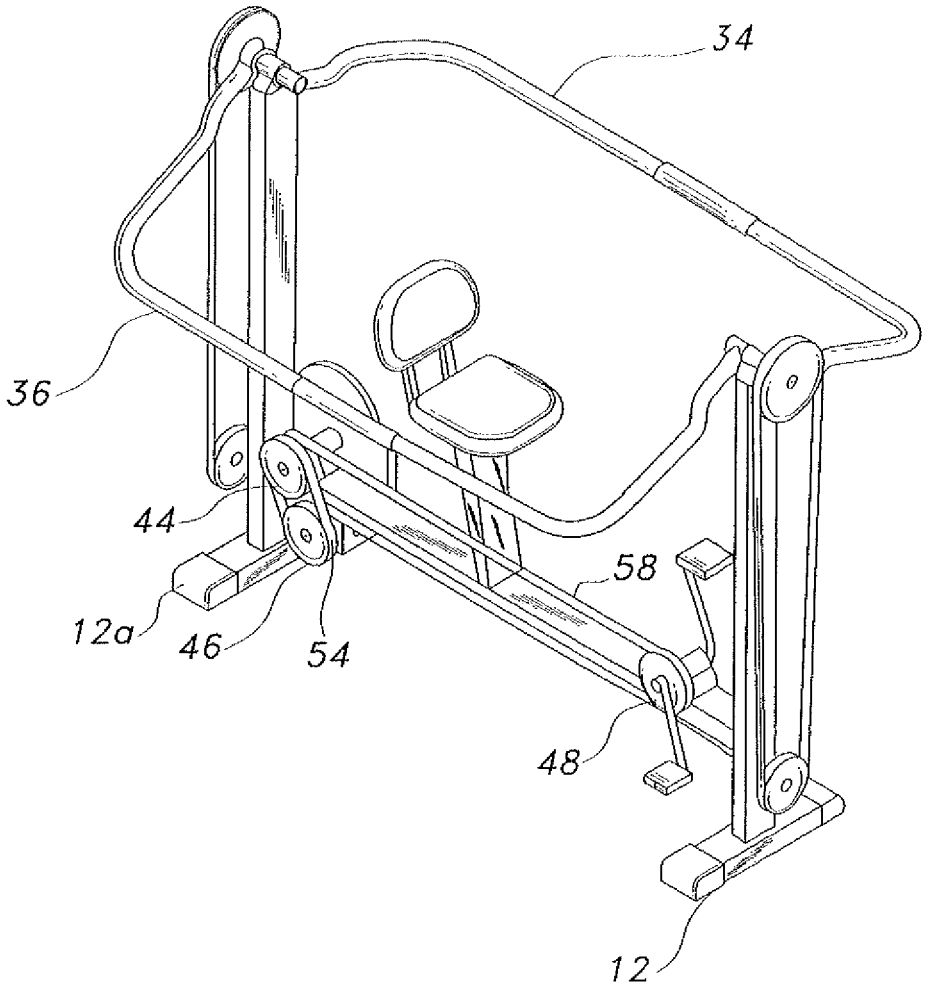
FIG. 7 is a perspective view of a fourth embodiment of an arm and leg exercising machine according to the present invention.

The embodiments of FIGS. 6 and 7 employ an additional belt 54 for pulleys 44, 46. In FIG. 6, the pulley 46 is a double sheave pulley, while in FIG. 7, the pulley 44 is a double sheave pulley. The use of a two-belt system allows for more flexibility with respect to optimizing flywheel speed and enhances traction between the belts and pulleys. Note that the drive belt 50 is equally effective when coupled to either pulley 46 (FIG. 6) or 44 (FIG. 7).

Figure 8:
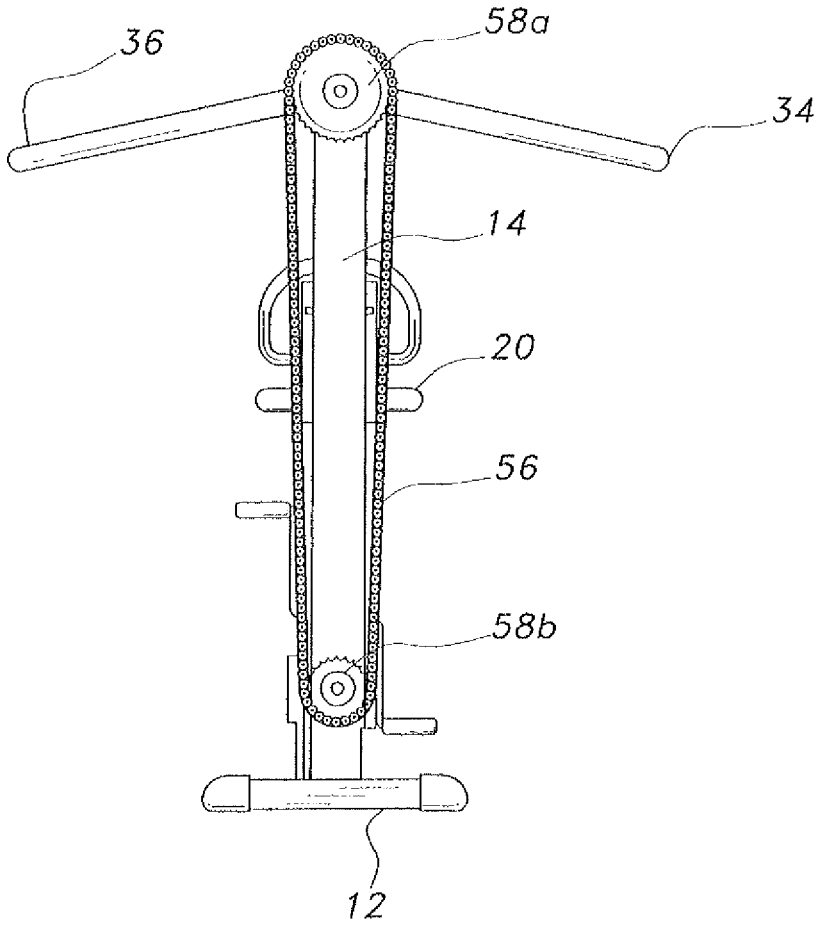
FIG. 8 is a front view showing an alternative embodiment of a forward drive mechanism of an arm and leg exercising machine according to the present invention.

The embodiment of FIG. 8 shows an alternative drive mechanism. A chain 56 and sprocket 58*a*, 58*b* mechanism replaces the pulley/belt mechanism of the prior embodiments. The chain/sprocket arrangement can be employed when it is necessary to transmit higher load and power, for example, when professional athletes use the machine. The mechanism can be utilized for both front and rear drives.

Figure 9:
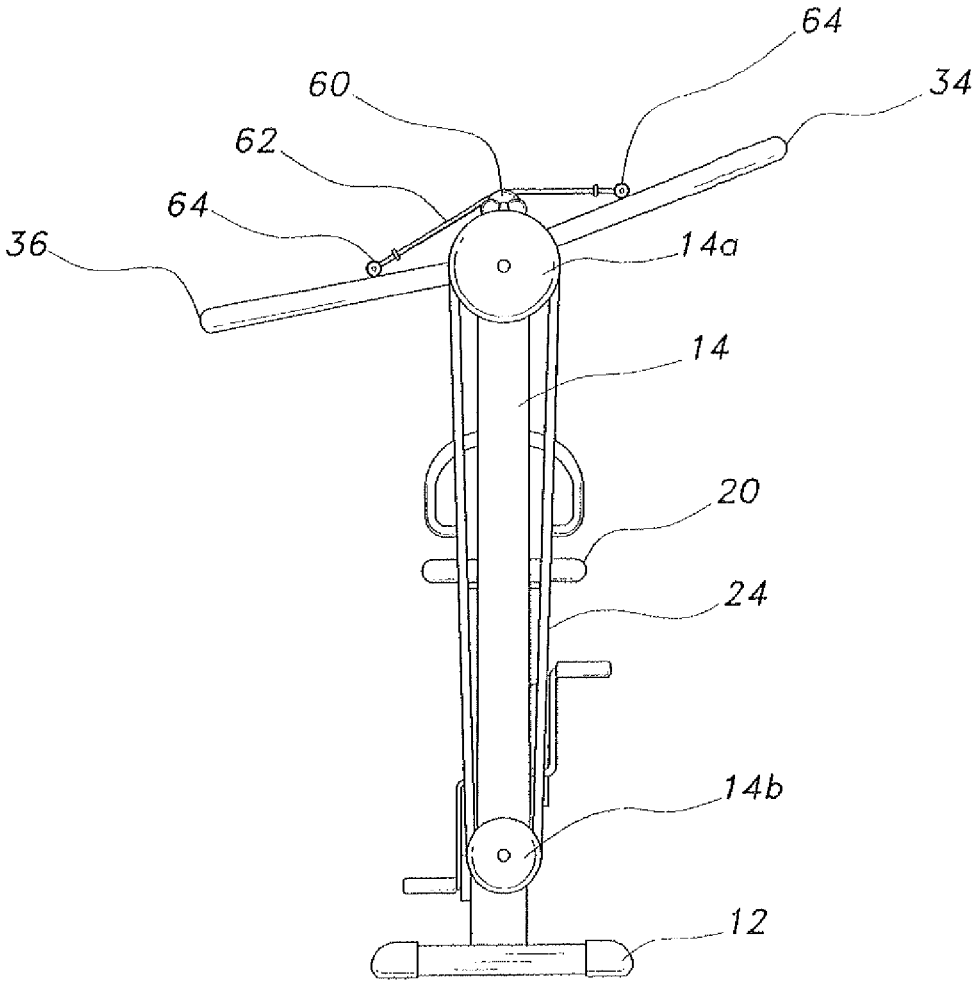
FIG. 9 is a front view showing an arm swinging synchronizer mechanism of an arm and leg exercising machine according to the present invention.

During the upper body exercise regimen, the operator uses alternative downward and upward swinging motion of the arms to provide power input to propel the device (upper and lower pulleys, flywheel, etc.). During continuous exercise, the upward swinging motion can cause unnecessary strain on the arms of the operant. To overcome this problem the device may be provided with a synchronizing swing mechanism, as best seen in FIG. 9. The synchronizing swing mechanism comprises a freely rotating idler pulley 60 that is attached to the upper end of the front vertical member 14. An elastic cable 62 engages the idler pulley. The ends of the elastic cable 62 are removably attached to fasteners 64 mounted on opposite lever arms 30. This arrangement allows the use of the input power supplied by the operator during the downward swing motion in one arm to raise the opposed handlebar, and vice versa. Although indicated as elastic, the cable 62 may alternatively be provided with two end springs (not shown), if desired.

It is to be understood that the present invention is not limited to the embodiments described above, but encompasses any and all embodiments within the scope of the following claims.

We claim:

1. An exercising machine for optionally exercising upper and lower extremities, comprising:

a U-shaped frame having a front end and a rear end spaced apart from the front end;

a horizontal tubular member extending between the front end and the rear end;

a split drive shaft encapsulated in the horizontal tubular member;

a seat mounted on the U-shaped frame between the front end and the rear end;

a front drive mechanism mounted on the frame and disposed adjacent the front end;

a rear drive mechanism mounted on the frame and disposed adjacent the rear end;

a middle drive mechanism mounted on the frame and disposed between the front end and the rear end;

a foot pedal pulley member mounted on the frame, the foot pedal pulley member being connected to the middle drive mechanism and actuating the middle drive mechanism when the foot pedal pulley member is rotated;

first and second handlebar members disposed on opposite sides of the seat, the first handlebar member being connected to the front drive mechanism and actuating the front drive mechanism when the first handlebar member is pivoted, the second handlebar member being connected to the rear drive mechanism and actuating the rear drive mechanism when the second handlebar member is pivoted;

wherein a user optionally exercises upper body members by pivoting the handlebars, exercises lower body members by rotating the foot pedal pulley member, or exercises both upper and lower body members by simultaneously pivoting the handlebar members and rotating the foot pedal pulley member.

2. The exercising machine according to claim 1, wherein said front end includes a front base having a front vertical member mounted thereon, the front vertical member having an upper end, said front drive mechanism being mounted on the front vertical member.

3. The exercising machine according to claim 1, wherein said rear end includes a rear base having a rear vertical member mounted thereon, the rear vertical member having an upper end, said rear drive mechanism being mounted on the rear vertical member.

4. The exercising machine according to claim 1, wherein said front drive mechanism includes an upper pulley mounted on an upper front shaft, a lower pulley mounted on said drive shaft, and a drive belt engaging said upper pulley and said lower pulley.

5. The exercising machine according to claim 4, further comprising a freewheeling clutch disposed on the upper front shaft adjacent the upper pulley, the clutch ensuring unidirectional rotation of said upper pulley.

6. The exercising machine according to claim 1, wherein said rear drive mechanism includes an upper pulley mounted on an upper rear shaft, a lower pulley mounted on said drive shaft, and a drive belt engaging said upper pulley and said lower pulley.

7. The exercising machine according to claim 4, further comprising a freewheeling clutch disposed on the upper rear shaft adjacent the upper pulley, the clutch ensuring unidirectional rotation of said upper pulley.

8. The exercising machine according to claim 1, wherein:

said drive shaft has a front portion having a front end attached to said front drive mechanism, and a rear end having a first bevel gear mounted thereon;

said drive shaft has a rear portion having a second bevel gear mounted thereon, and a rear end attached to said rear drive mechanism; and said middle drive mechanism comprises at least one pulley having a shaft extending therefrom, the shaft having a third bevel gear mounted thereon, the third bevel gear being orthogonal to and disposed between the first and second bevel gears, the third bevel gear meshing with the first bevel gear to interconnect said front drive mechanism and said middle drive mechanism, the third bevel gear also meshing with the second bevel gear to interconnect said rear drive mechanism and said middle drive mechanism, whereby actuation of one of said drive mechanisms passively actuates the other two said drive mechanisms.

9. The exercising machine according to claim 8, wherein the at least one pulley of said middle drive mechanism comprises a double pulley, one of the pulleys of said double pulley having a flywheel shaft extending therefrom and a flywheel mounted on the flywheel shaft.

10. The exercising machine according to claim 9, further including a belt engaging said double pulley and said foot pedal-pulley member.

11. The exercising machine according to claim 8, wherein said at least one pulley comprises a double sheave pulley, said middle drive mechanism further comprising:

a first drive belt engaging one of the sheaves and said foot pedal pulley member;

a second pulley having a flywheel extending therefrom; and a second belt engaging the other sheave and the second pulley.

12. The exercising machine according to claim 1, further comprising:

a synchronizer pulley extending upward from the front end of said U-shaped frame member; and an elongated elastic cord having a first end attached to said first handlebar member and a second end attached to said second handlebar member, the cord having a middle portion extending around the synchronizer pulley.

13. The exercising machine according to claim 1, wherein said front drive mechanism includes a chain and sprocket mechanism having:

a shaft extending from the front end of said U-shaped frame;

an upper sprocket rotatably mounted on the shaft extending from the U-shaped frame;

a lower sprocket mounted on said drive shaft; and a chain connecting the upper sprocket and the lower sprocket.

14. An arm and leg exercising machine, comprising:

a U-shaped frame having spaced apart front and rear upright members and a cross member extending between the front and rear upright members;

a front drive shaft rotatably journaled in the front upright member and extending toward the rear upright member, the front drive shaft having a front end and a rear end;

a first bevel gear mounted on the rear end of the front drive shaft;

a rear drive shaft rotatably journaled in the rear upright member and extending toward the front upright member, the rear shaft having a front end and a rear end;

a second bevel gear mounted on the front end of the rear drive shaft;

a front drive mechanism having:

a front upper shaft extending from and rotatably mounted to the front upright member;

a freewheeling clutch rigidly attached to the front upper shaft;

an upper pulley mounted on the front upper shaft;

a lower pulley rigidly mounted on the front end of the front drive shaft; and a belt extending around the upper and lower pulleys;

a rear drive mechanism having:

a rear upper shaft extending from and rotatably mounted to the rear upright member;

a freewheeling shaft rigidly attached to the rear upper shaft;

an upper pulley rotatably mounted on the rear upper shaft;

a lower pulley rigidly mounted on the rear end of the rear drive shaft; and a belt extending around the upper and lower pulleys of said rear drive mechanism;

a seat support extending upward from the cross member of the frame;

a seat mounted on the seat support;

a first lateral handlebar assembly having:

a first lever arm rigidly fixed to the freewheeling clutch attached to the front upper shaft;

a second lever arm rotatably attached to the rear upper shaft; and a first handlebar extending between the first and second lever arms laterally spaced from the seat, the first handlebar assembly actuating the front drive mechanism when rotated in one direction, but rotating freely on the upper shafts when rotated in an opposite direction;

a second lateral handlebar assembly having:

a third lever arm rigidly fixed to the freewheeling shaft attached to the rear upper shaft;

a fourth lever arm rotatably attached to the front upper shaft; and a second handlebar extending between the third and fourth lever arms laterally spaced from the seat opposite the first handlebar, the second handlebar assembly actuating the rear drive mechanism when rotated in one direction, but rotating freely on the upper shafts when rotated in an opposite direction;

a central drive mechanism having:

a foot pedal-pulley assembly mounted to the frame;

a double pulley mounted on the frame and spaced apart from the pedal-pulley assembly, the double pulley having a first pulley and a first pulley shaft extending therefrom, and a second pulley and a second pulley shaft extending therefrom orthogonal to the front and rear drive shafts;

a flywheel mounted on the first pulley shaft;

a third bevel gear mounted on the second pulley shaft, the third bevel gear meshing with the first bevel gear and also meshing with the second bevel gear; and a drive belt extending around the foot pedal-pulley assembly and the double pulley;

whereby a user optionally exercises upper body members by pivoting the handlebars, exercises lower body members by rotating the foot pedal-pulley assembly, or exercises both upper and lower body members by simultaneously pivoting the handlebar members and rotating the foot pedal-pulley assembly.

* * * * *